United States Patent [19]

Witczak

[11] Patent Number: 5,022,321

[45] Date of Patent: Jun. 11, 1991

[54] DISTRIBUTION ROLLER DRIVE SYSTEM FOR PRINTING OR DUPLICATING MACHINES

[75] Inventor: Stanley Witczak, Chicago, Ill.

[73] Assignee: AM International, Inc., Chicago, Ill.

[21] Appl. No.: 421,557

[22] Filed: Oct. 13, 1989

[51] Int. Cl.[5] ..... B41F 7/24

[52] U.S. Cl. ..... 101/142; 101/148

[58] Field of Search ..... 101/148, 147, 350, 142

[56] References Cited

U.S. PATENT DOCUMENTS 3,688,694 9/1972 Preuss et al. ..... 101/148

3,991,674 11/1976 Petri ..... 101/148

FOREIGN PATENT DOCUMENTS 2822350 12/1978 Fed. Rep. of Germany ..... 101/148

*Primary Examiner*—Clifford D. Crowder

*Attorney, Agent, or Firm*—Nicholas A. Camasto; John R. Hoffman

[57] ABSTRACT

A drive system between a master cylinder, a form roller and a distributor roller in a moisture system of a printing, duplicating or like machine. The surface of the master cylinder has a longitudinal gap within which master clamping hardware are disposed. The drive system includes a first gear train, including a lost motion mechanism, between the master cylinder and the form roller for rotating the form roller only during an interval of a revolution of the master cylinder when the surface of the form roller is juxtaposed in the gap of the master cylinder. A second gear train independent of the first gear train is disposed between the form roller and the distributor roller for rotating the distributor roller continuously at the same surface speed as the form roller.

4 Claims, 2 Drawing Sheets

DISTRIBUTION ROLLER DRIVE SYSTEM FOR PRINTING OR DUPLICATING MACHINES

FIELD OF THE INVENTION

This invention generally relates to printing or duplicating machines and, more particularly, to a drive system for a distributor roller in a printing couple of the machine.

BACKGROUND OF THE INVENTION

Printing machines, such as rotary offset lithographic duplicating machines, rotary printing presses, or the like, normally include a printing couple which comprises a number of cylinders and/or rollers such as impression cylinders, master cylinders, blanket cylinders, form rollers, ductor rollers, transfer rollers, distributor rollers, regulator rollers, oscillating rollers, and the like. An ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple.

A typical moisture feeding system includes a moisture fountain with a fountain roller for picking up moisture from the fountain. The moisture is fed to a master cylinder from the fountain roller to a ductor roller, from the ductor roller to a distributor roller, from the distributor roller to a form roller, and, finally, from the form roller to the master cylinder. The moisture transfer is accomplished through surface contact between the peripheral surfaces of the respective rollers. The ductor roller reciprocates bodily in an arc between the fountain roller and the distributor roller and, therefore, intermittently rotates and consequently is not directly affected by down-line rotation of the master cylinder. On the other hand, the distributor roller is in continuous surface contact with the form roller which, in turn, is in surface contact with the master cylinder. The master cylinder actually drivingly rotates the form roller through surface contact.

A continuing problem with moisture systems of the character described is to maintain, as close as possible, equal surface speed between the master cylinder and the form roller and between the form roller and the distributor roller. Any slippage, particularly abrupt slippage, results in what is termed in the art "skid marks" in the moisture and/or ink film which is transferred to the copy sheets and which results in poor copy quality.

This problem is magnified when considering that a typical master cylinder does not have a cylindrical surface, a full 360° about the periphery of the cylinder. A "gap", which actually is a recessed area of the cylindrical surface, is provided for mounting various hardware for holding or clamping the master onto the peripheral surface of the master cylinder. When this gap rotates into juxtaposition with the form roller, there no longer is any surface contact between the master cylinder and the form roller and, consequently, the surface of the cylinder does not rotatably drive the form roller during this rotational increment. Consequently, it has become conventional to provide gears between the master cylinder and the form roller, the gears having lost motion means built into them. In other words, when the gap in the master cylinder becomes rotatingly juxtaposed with the form roller, the gears take over to rotate the form roller during an increment of rotation equal to the arc of the gap and, when the cylindrical surface of the master cylinder again engages the form roller, the lost motion means in the gears allows the master cylinder to surface drive the form roller until the gap again becomes juxtaposed with the form roller.

Because the above-described gear train between the master cylinder and the form roller is only intermittently effective, the gear train cannot be used to rotate the distributor roller. Therefore, in order to control the rotation of the distributor roller, electronic sensors have been used to monitor the speed of rotation of the distributor roller. Such sensor monitoring systems must be continuously maintained and calibrated and repeatedly have timing problems. Such systems often provide too tight of a control and often result in intermittent variances in surface speed between the distributor roller and the form roller.

This invention is directed to solving the above problems by a very simple drive system between the distributor roller and the form roller which is totally independent of the lost motion drive system between the form roller and the master cylinder and which obviates all of the maintenance, monitoring and timing problems of conventional systems described above.

SUMMARY OF THE INVENTION

An object, therefore, of the invention is to provide a new and simple drive system between the master cylinder, form roller and distributor roller in a moisture system of a printing, duplicating or like machine.

In the exemplary embodiment of the invention, the moisture system has at least a distributor roller and a form roller for distributing moisture to a rotatably driven master cylinder of a printing couple of the machine. The distributor roller is in surface contact with the form roller which, in turn, is in surface driven contact with the master cylinder. The surface of the master cylinder has a longitudinal gap within which master clamping means are disposed. The invention contemplates a drive system between the master cylinder, the form roller and the distributor roller, including first and second gear train means. The first gear train means include lost motion means and are operatively associated between the master cylinder and the form roller for rotating the form roller only during an interval of a revolution of the master cylinder when the surface of the form roller is juxtaposed in the gap of the master cylinder. The second gear train means are operatively associated between the form roller and the distributor roller for rotating the distributor roller continuously at the same surface speed as the form roller.

As illustrated herein, the first gear train means are connected to one axial end of the form roller and the second gear train means are connected to the opposite axial end of the form roller.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
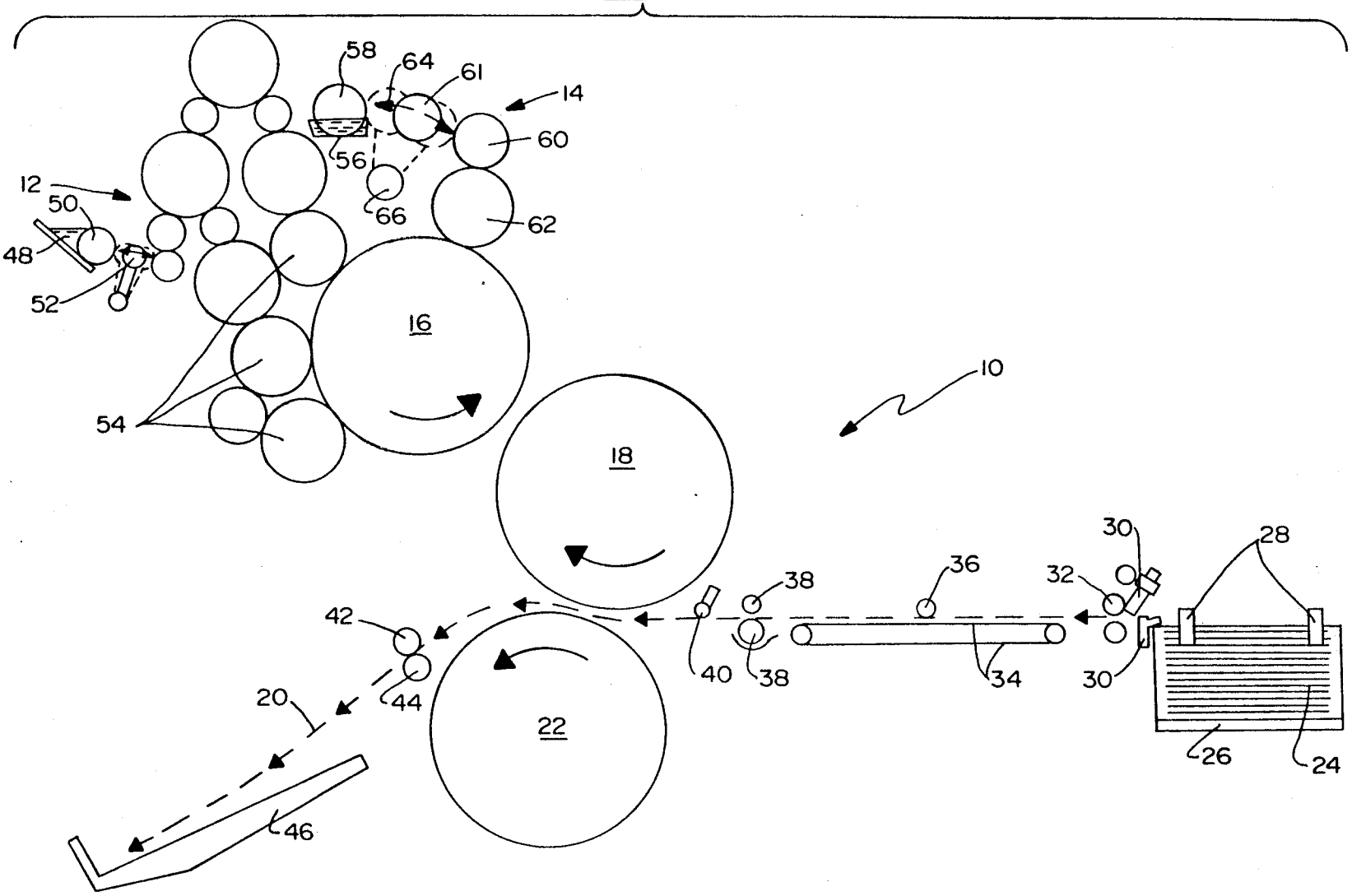
FIG. 1 is a schematic illustration of the major components of a printing press or duplicating machine with which the invention is applicable.

Referring to the drawings in greater detail, and first to FIG. 1, the major components of a printing or duplicating machine, generally designated 10, are shown schematically in generally applicable functional positions. The machine depicted is an offset lithographic duplicating machine which includes an ink system, generally designated 12, and a moisture system, generally designated 14, for feeding ink and moisture, respectively, to a master cylinder 16 to which a master is clamped. An image from the master is transferred to a blanket cylinder 18, through surface transfer. The blanket cylinder transfers the image to a copy sheet which follows a paper path through the machine as indicated by dotted-arrow line 20 which passes between blanket cylinder 18 and an impression cylinder 22.

Generally, paper sheets are stacked, as at 24, in a paper elevator 26. Air blowers 28, vacuum feet 30 and pull-out wheels 32 feed the sheets seriatum to a sheet transport conveyor 34 above which are mounted skid wheels 36. From conveyor 34, the sheets are fed seriatum by feed rollers 38 beneath a paper guide assembly 40 and between blanket cylinder 18 and impression cylinder 22, as described above. After images are transferred to the copy sheets, a paper ejector wheel 42 and a paper ejector roller 44 feed the sheets to a discharge station, generally designated 46.

Ink system 12 will be described generally and briefly, and includes an ink fountain 48 having a fountain roller 50. A ductor roller 52 feeds the ink from fountain roller 50 to a number of transfer rollers, regulator rollers, oscillating rollers and, ultimately, to three ink form rollers 54 which transfer the ink to a master on master cylinder 16 by surface contact.

Moisture system 14 includes a moisture fountain trough 56 and a fountain roller 58. Moisture is transferred from fountain roller 58 to a distributor roller 60 by a ductor roller 61 which reciprocates back and forth in the direction of double-headed arrow 64, about pivot 66, between fountain roller 58 and distributor roller 60. The construction and operation of the ductor roller is well known in the art. Moisture then is transferred, through continuous surface contact from distributor roller 60 to a form roller 62 which, in turn, transfers the moisture to the master on master cylinder 16, again through surface contact.

Figure 2:
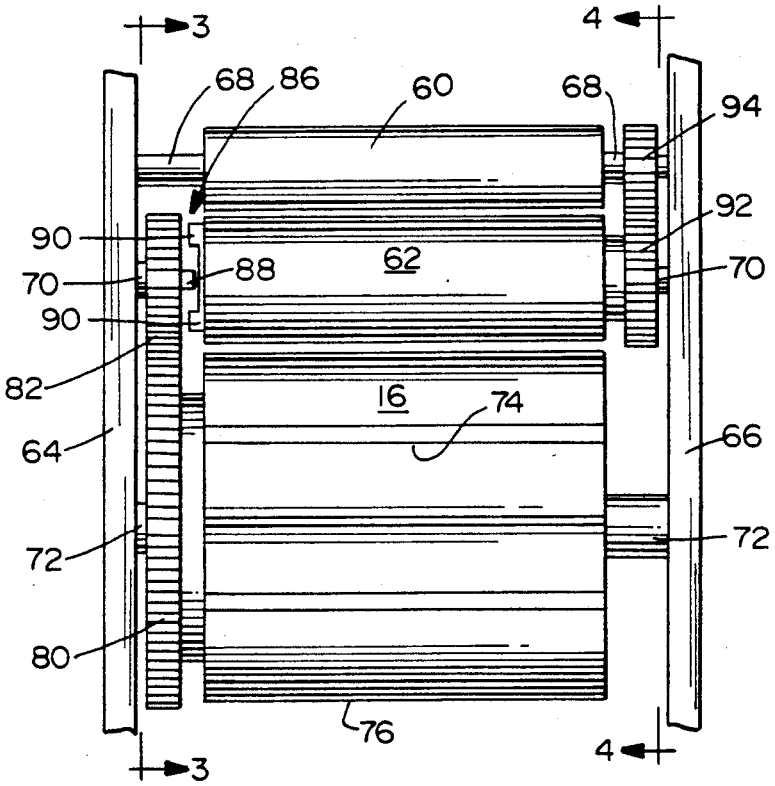
FIG. 2 is an elevational view of the master cylinder, form roller and distributor roller of the moisture system of the machine, incorporating the independent gear train means of the invention.

FIG. 2 shows distributor roller 60, moisture form roller 62 and master cylinder 16 rotatably mounted between side plates 64 and 66 of the machine. The rollers and cylinder are illustrated shorter in dimensions than in actual practice simply to facilitate the illustration. Distributor roller 60 includes a shaft 68 journaled by appropriate bearing means in side plates 64 and 66, form roller 62 includes a shaft 70 journaled by appropriate bearing means in side plates, 64 and 66, and master cylinder 16 includes a shaft 72 journaled by appropriate bearing means in side plates 64 and 66. The master cylinder is driven by a central power source of the machine (not shown), such as through a gear 80 described below. It should be noted that master cylinder 16 has a gap 74 in its cylindrical surface 76 and extending longitudinally of the cylinder. As described above, this gap actually is a recessed area for accommodating appropriate hardware (not shown) for holding or clamping the ends of a master so that the master is tightly disposed to the cylindrical surface of the cylinder, all of which is well known in the art.

Figure 3:
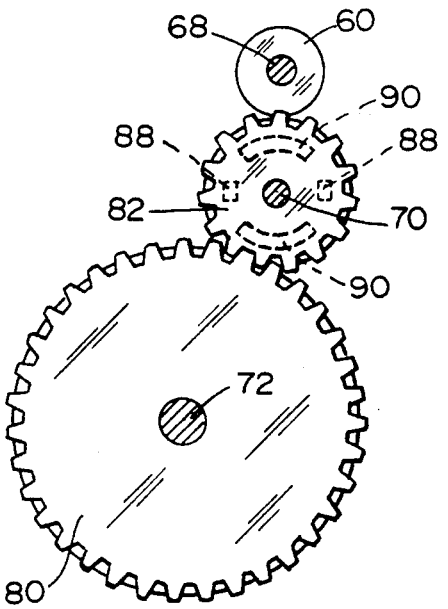
FIG. 3 is a vertical section taken generally along line 3—3 of FIG. 2, through the roller shafts to show an end elevational view of the gear train between the master cylinder and the form roller.

Referring to FIG. 3 in conjunction with FIG. 2, first drive means in the form of a first gear train, including lost motion means, are operatively associated between master cylinder 16 and form roller 62 for rotating the form roller only during an interval of a revolution of the master cylinder when the surface of the form roller is juxtaposed in gap 74 of the master cylinder. More particularly, a master cylinder gear 80 is fixed to shaft 72 of the master cylinder and is in mesh with a gear 82 which is freely rotatable on shaft 70 of form roller 62. In other words, gear 82 is not fixed to shaft 70 of form roller 62. Instead, lost motion means, generally designated 86 (FIG. 2) are operatively associated between gear 82 and the form roller. This lost motion means is generally known in the art and includes a pair of drive pins 88 fixed to and projecting axially inwardly of the inner face of gear 82, i.e., toward the adjacent end face of form roller 62. A pair of arcuate hub segments 90 are fixed to and project axially outwardly toward the inner face of gear 82. It can be seen in FIG. 2 that pins 88 and hub segments 90 are in a common path of revolution, but it can be seen in FIG. 3 that the pins can be located between the ends of the segments, i.e., out of engagement therewith. This typical lost motion means is used in duplicating machines to provide a positive drive from the master cylinder to the form roller when the surface of the form roller is juxtaposed in gap 74 of the cylinder, but to provide lost motion between pins 88 and segments 90 to allow the surface of the cylinder (actually the surface of the master thereon) to drive form roller 62 at the same surface speed.

From the foregoing, it can be understood that the critically of slippage between master cylinder 16 and form roller 62 is not all that critical when the cylinder and the roller change from their surface driven mode to their gear driven mode because practically all copy sheets begin and end with a margin to which no ink is applied and, therefore, no "skid marks" are even of concern. On the other hand, form roller 62 is in constant or 360° continuous surface engagement with distributor roller 60. Any momentary stopping or starting or variances in speed between the form roller and the distributor roller will result in skid marks and poor copy quality. In order to avoid these apparent problems and to avoid all of the above-described prior sensor controlling systems for the distributor roller, the invention contemplates a simple direct drive from the form roller to the distributor roller, which is totally independent of the drive system (FIG. 3) between the master cylinder and the form roller.

Figure 4:
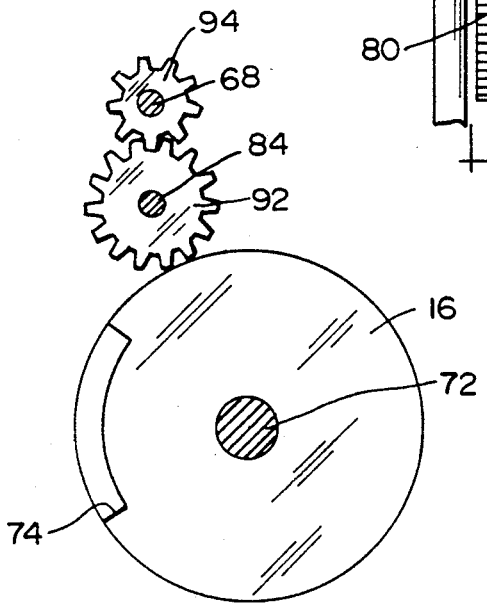
FIG. 4 is a vertical section taken generally along line 4—4 of FIG. 2, through the roller shafts to show an end elevational view of the gear train between the form roller and the distributor roller.

More particularly, referring to FIG. 4 in conjunction with FIG. 2, a gear 92 is fixed to shaft 70 of moisture form roller 62 in mesh with a gear 94 fixed to distributor roller shaft 68. It can be seen in FIG. 4 that the sizes of the gears correspond to the diametral sizes of the respective rollers to provide the same surface speed therefore. By providing this separate gear train between form roller 62 and distributor roller 60, the driving connection between the rollers is independent of the driving connection between the form roller and master cylinder 16. This is easily understood by comparing the gears on opposite ends of form roller 62 in that gear 92 on the right-hand end of the roller is fixed to the roller shaft and therefore integrally with the roller, whereas gear 82 at the left-hand end of the form roller is freely rotatable on the roller shaft and is separated from the form roller by lost motion means 86 which accommodates the gap in master cylinder 16, as described above. Consequently, there is provided a continuous direct drive between the form roller and the distributor roller, and an intermittent direct drive between the form roller and the master cylinder.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating or like machine, comprising:

a printing couple including a rotatably driven master cylinder having a longitudinal gap within which master clamping means are disposed;

a moisture system having at least a distribution roller and a form roller for distributing moisture to the master cylinder, the distributor roller being in surface contact with the form roller which, in turn, is in surface driven contact with the master cylinder;

first gear train means, including lost motion means, between the master cylinder and the form roller for rotating the form roller only during an interval of a revolution of the master cylinder when the surface of the form roller is juxtaposed in the gap of the master cylinder; and second gear train means between the form roller and the distributor roller for rotating the distributor roller continuously at the same surface speed as the form roller.

2. The drive system of claim 1 wherein said first gear train means are connected to one axial end of the form roller and said second gear train means are connected to an opposite axial end of the form roller.

3. In a printing, duplicating or like machine, comprising:

a printing couple including a rotatably driven master cylinder having a longitudinal gap within which master clamping means are disposed;

a moisture system having at least a distribution roller and a form roller for distributing moisture to the master cylinder, the distributor roller being in surface contact with the form roller which, in turn, is in surface driven contact with the master cylinder;

first drive means, including lost motion means, between the master cylinder and the form roller for rotating the form roller only during an interval of a revolution of the master cylinder when the surface of the form roller is juxtaposed in the gap of the master cylinder; and second drive means independent of the first drive means between the form roller and the distributor roller for rotating the distributor roller continuously at the same surface speed as the form roller.

4. The drive system of claim 3 wherein said first drive means are operatively connected to one axial end of the form roller and said second drive means are operatively connected to an opposite axial end of the form roller.

* * * * *